US008695168B1

(12) United States Patent
Cepeda

(10) Patent No.: US 8,695,168 B1
(45) Date of Patent: Apr. 15, 2014

(54) SANITARY HANDLE COVER

(71) Applicant: Frances Cepeda, Teaneck, NJ (US)

(72) Inventor: Frances Cepeda, Teaneck, NJ (US)

( * ) Notice: Subject to any disclaimer, the term of this patent is extended or adjusted under 35 U.S.C. 154(b) by 0 days.

(21) Appl. No.: 13/715,261

(22) Filed: Dec. 14, 2012

(51) Int. Cl.
*B25G 1/10* (2006.01)

(52) U.S. Cl.
USPC ..... 16/435; 16/431; 16/428; 16/421; 16/422; 16/413

(58) Field of Classification Search
CPC ..... B25G 1/01; B25G 1/02; B25G 1/06; B25G 1/102; B25G 3/00; B25G 3/12; B25G 3/34; A45F 5/10
USPC ..... 16/421, 422, 428, 430, 431, 435, 413, 16/DIG. 12; 294/171, 15, 102.1, 102.2, 294/137, 132; 74/551.9; 15/144.1, 144.2, 15/144.3, 143.1, 145
See application file for complete search history.

(56) References Cited

U.S. PATENT DOCUMENTS

| | | | | | |
|---|---|---|---|---|---|
| 4,262,385 | A * | 4/1981 | Norman | 16/411 |
| 4,366,596 | A | 1/1983 | Hellinger et al. | |
| 5,469,601 | A | 11/1995 | Jackson | |
| 5,511,445 | A * | 4/1996 | Hildebrandt | 74/558.5 |
| 6,006,403 | A * | 12/1999 | Battiato | 16/421 |
| 6,543,794 | B1 | 4/2003 | Tyree | |
| 6,604,789 | B1 * | 8/2003 | Downing | 297/227 |
| 6,767,419 | B1 * | 7/2004 | Branagan | 148/522 |
| 6,796,002 | B2 | 9/2004 | Beckwith | |
| 7,232,352 | B2 * | 6/2007 | Splaine | 440/101 |
| D667,241 | S * | 9/2012 | Winnail | D6/500 |
| 2003/0131447 | A1 * | 7/2003 | Mikus | 16/422 |
| 2005/0177983 | A1 * | 8/2005 | Holms | 16/435 |
| 2005/0178850 | A1 * | 8/2005 | Lumsden | 239/103 |
| 2006/0210763 | A1 * | 9/2006 | Holms | 428/100 |
| 2008/0235914 | A1 * | 10/2008 | Dolberg | 16/430 |
| 2009/0056844 | A1 * | 3/2009 | Schanz | 150/154 |

FOREIGN PATENT DOCUMENTS

| | | | |
|---|---|---|---|
| JP | 11277977 | A * | 10/1999 |
| KR | 2006083924 | A * | 7/2006 |

* cited by examiner

*Primary Examiner* — Chuck Mah

(57) ABSTRACT

A sanitary handle cover that includes a fabric strip having a first flap attached to a first long edge and a second flap attached to a second long edge, said first and second flaps including fastening means whereby the first flap and the second flap secure together to releasably attach the fabric strip around a handle of a particular appliance in question, wherein a grounding strip disposed interiorly within the fabric strip along a longitudinal axis resists rotation of the device around said handle and prevents the discharge of static electricity through the device, whereby the sanitary handle cover is washable and maintains a sanitary surface upon an underlying handle to which the device is releasably attached.

13 Claims, 3 Drawing Sheets

SANITARY HANDLE COVER

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of handle covers are known in the prior art. However, what is needed is a sanitary handle cover that includes a fabric strip having a first flap attached to a first long edge and a second flap attached to a second long edge, said first and second flaps including fastening means whereby the first flap and the second flap secure together to releasably attach the fabric strip around a handle of a particular appliance in question, wherein a grounding strip disposed interiorly within the fabric strip along a longitudinal axis resists rotation of the device around said handle and prevents the discharge of static electricity through the device, whereby the sanitary handle cover is washable and maintains a sanitary surface upon an underlying handle to which the device is releasably attached.

FIELD OF THE INVENTION

The present invention relates to a sanitary handle cover, and more particularly, to a sanitary handle cover that includes a fabric strip having a first flap attached to a first long edge and a second flap attached to a second long edge, said first and second flaps including fastening means whereby the first flap and the second flap secure together to releasably attach the fabric strip around a handle of a particular appliance in question, wherein a grounding strip disposed interiorly within the fabric strip along a longitudinal axis resists rotation of the device around said handle and prevents the discharge of static electricity through the device, whereby the sanitary handle cover is washable and maintains a sanitary surface upon an underlying handle to which the device is releasably attached.

SUMMARY OF THE INVENTION

The general purpose of the sanitary handle cover, described subsequently in greater detail, is to provide a sanitary handle cover which has many novel features that result in a sanitary handle cover which is not anticipated, rendered obvious, suggested, or even implied by prior art, either alone or in combination thereof.

When cooking and preparing foods for consumption, a person regularly removes and returns foods from the refrigerator or other storage area. Oftentimes, a person must engage a handle to access said storage area, particularly a refrigerator. Foodstuffs upon the hand, and other germs or pathogens, are inadvertently transported to the handle of said refrigerator, or other storage area, whereby said handle may act as a vector for introducing pathogens to foods prepared in the kitchen or returned to said storage area.

The same is true for the handles disposed on oven doors and other kitchen appliances (including, but not limited to, dishwashers and the like). Moreover, dirt on the hands, or remnants of food prepared in the kitchen, often discolor and mar the handle of said appliances whereby repeated cleaning is required to maintain a sanitary workspace.

The present device eliminates these problems while adding to the décor of a kitchen. The present device releasbly attaches around an appliance handle to cover said handle. The present device is readily removable for cleaning or washing, as desired.

The present device, therefore, includes a fabric strip configured with a first flap disposed along a first long edge and a second flap disposed along a second long edge. The first and second flaps are releasably attachable to each other whereby the fabric strip is releasably attachable to the handle.

A grounding strip is disposed interiorly within the fabric strip along a longitudinal axis. The grounding strip provides stiffness and resists rotational movement of the strip around the handle to which the device is attached. The grounding strip may also serve as an insulator or conductor to preempt the discharge of static electricity through the device to a person contacting the device when seeking to open or close the particular appliance to which the device is attached.

A frilled edge is disposed on each of a first short edge and a second short edge disposed upon the fabric strip. Each frilled edge extends from the fabric strip and covers the ends of the handle to which the device is releasably attached.

The fabric strip is considered as reversible, enabling a person to releasably attach the device to a particular handle in question with either surface of the fabric strip disposed outfacing from the handle. This enables a user to change the situation of the strip to switch up the décor in the kitchen and for continued use between cleanings.

The fabric strip may be wrought of cloth, or other durable fabric, suited for frequent washing, or a polymeric substance (such as vinyl, for example) able to be readily wiped clean between uses.

Thus has been broadly outlined the more important features of the present sanitary handle cover so that the detailed description thereof that follows may be better understood and in order that the present contribution to the art may be better appreciated.

Objects of the present sanitary handle cover, along with various novel features that characterize the invention are particularly pointed out in the claims forming a part of this disclosure. For better understanding of the sanitary handle cover, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
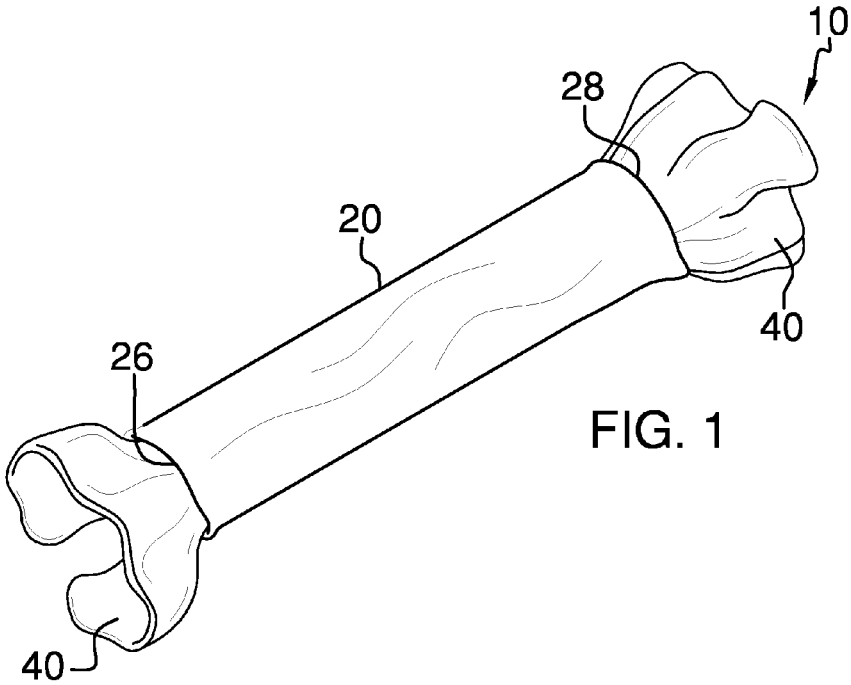
FIG. 1 is an isometric view.

With reference now to the drawings, and in particular FIGS. 1 through 6 thereof, example of the instant sanitary handle cover employing the principles and concepts of the present sanitary handle cover and generally designated by the reference number 10 will be described.

Referring to FIGS. 1 through 6 a preferred embodiment of the present sanitary handle cover 10 is illustrated.

The present sanitary handle cover 10 has been devised to provide a sanitary means to surround and cover the handle of a kitchen appliance, such as a stove, oven, dishwasher, or refrigerator, for example. The present sanitary handle cover 10 releasably fastens around said handle to prevent direct contact with said handle when using said handle. Thus, the sanitary handle cover can be readily removed from the handle in question, washed, and returned for use, as desired, to maintain a sterile surface of, and sanitary contact with, a handle of a particular kitchen appliance.

The sanitary handle cover 10 includes a fabric strip 20 having a first long edge 22, a second long edge 24, a first short edge 26, and a second short edge 28. A first flap 30 is disposed along the first long edge 22 and a second flap 32 is disposed along the second long edge 24.

Figure 2:
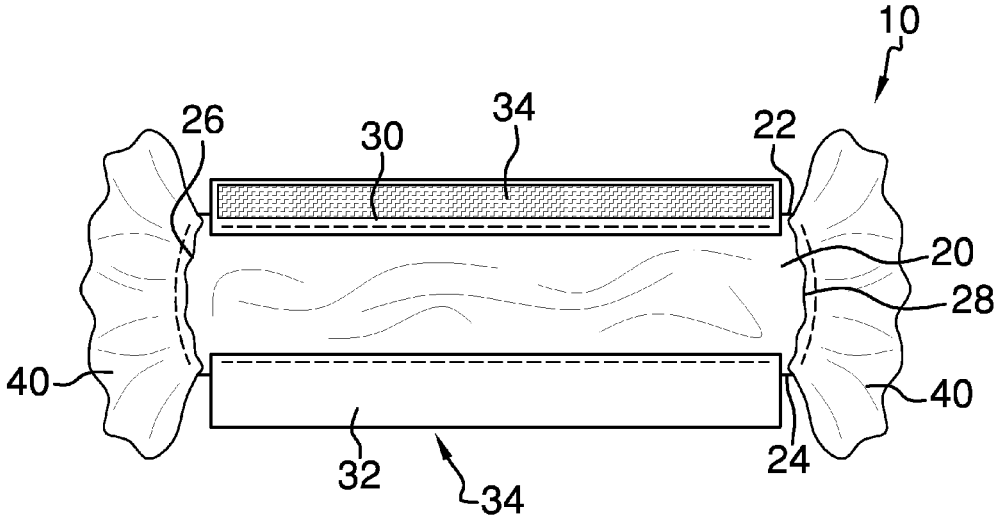
FIG. 2 is a top view.
Figure 3:
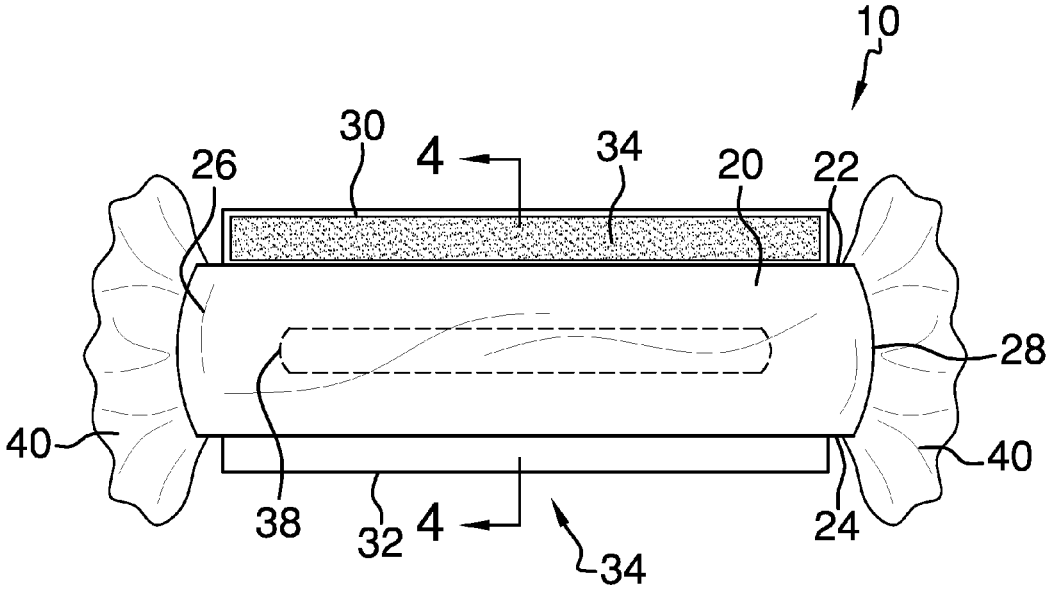
FIG. 3 is a bottom view.
Figure 4:
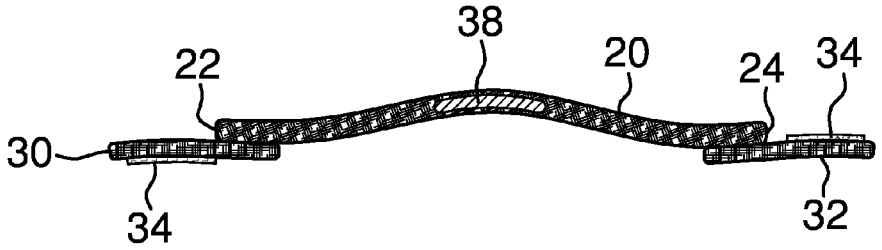
FIG. 4 is a cross-section view taken along the line 4-4 of FIG. 3.
Figure 5:
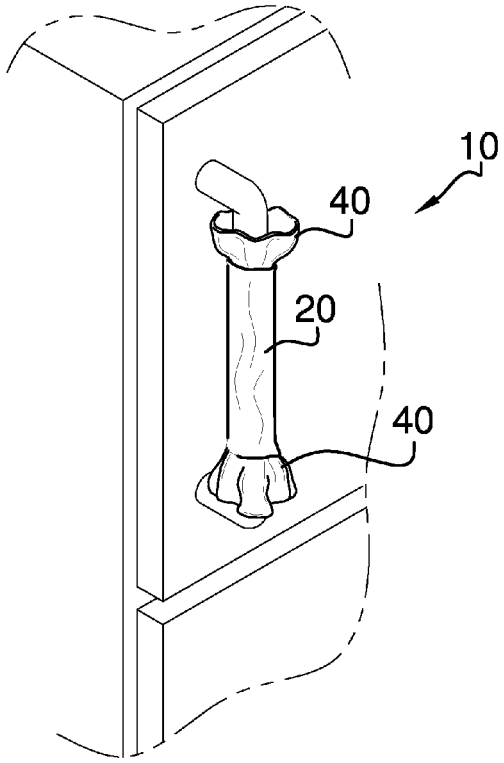
FIG. 5 is an in-use view.

Fastening means is disposed to releasably attach opposing surfaces of the first flap 30 and the second flap 32 together, to releasably secure the device 10 around the particular handle in question. Such fastening means may include a hook and loop fastener 34 (as shown in FIGS. 2, 3, and 4) disposed on opposing surfaces of each of the first flap 30 and the second flap 32 whereby the first and second flaps 30, 32 are releasably attachable together.

Figure 6:
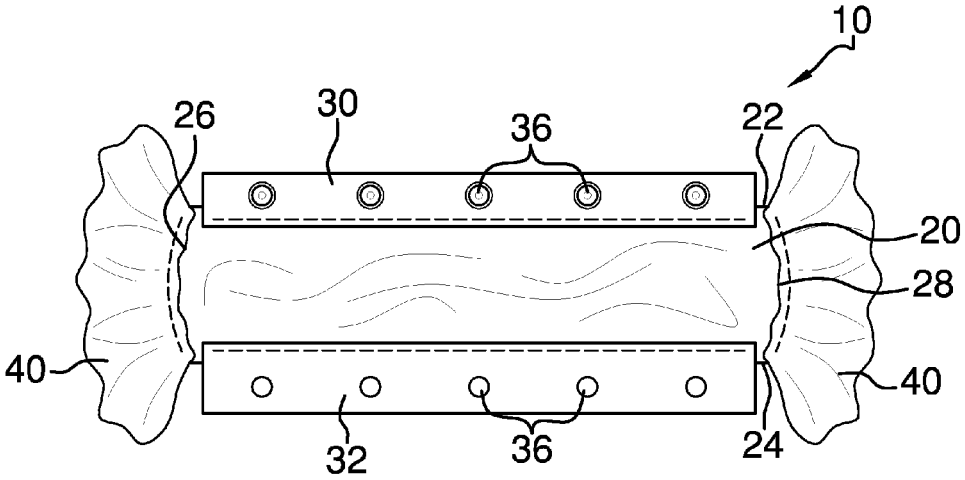
FIG. 6 is a top view of an alternate embodiment.

Alternatively, said fastening means may include a row of snaps 36 disposed on opposing surfaces of each of the first flap 30 and the second flap 32 (as shown in FIG. 6) whereby the first and second flaps 30, 32 are releasably attachable.

A grounding strip 38 is disposed within the interior of the fabric strip 20 along the longitudinal axis of the fabric strip 20. The grounding strip 38 provides stability and stiffness along the length of the fabric strip 20 by which the fabric strip 20 engages with the particular handle in question, whereby the fabric strip 20 resists rotation around said handle when the device 10 is used and a person opens or closes the particular appliance to which the device 10 is attached. The grounding strip 38 may also prevent discharges of static electricity through the device 10 when used proximal a metal surface (as, for example, when the device is used on an oven handle).

A frilled edge 40 is disposed on each of the first short edge 26 and the second short edge 28. Each frilled edge 40 extends from the respective first or second short edge 26, 28 to cover the ends of the handle with which the device 10 is used.

The present sanitary handle cover 10 is configured to be reversible—the fabric strip 20 may be releasably fastened around the particular handle in question with either surface disposed outfacing (see, for example, FIGS. 2 and 3). This enables varied use of the device 10 whereby a person can change the situation of the fabric strip 20 to provide variation of the décor in the home and to conceal stains from previous use between cleaning, as case may warrant.

The fabric strip 20 is considered to be either cloth, or another suitable fabric durable and easily washable, and alternately a polymeric substance, such as vinyl or plastic, capable of being wiped clean between uses.

What is claimed is:

1. A sanitary handle cover comprising:

a fabric strip having a first long edge and a second long edge;

a first flap disposed along the first long edge;

a second flap disposed along the second long edge;

a grounding strip disposed within the interior of the fabric strip; and fastening means disposed to releasably attach the first flap to the second flap;

wherein the fabric strip is releasably attachable around a handle disposed on a kitchen appliance whereby the fabric strip covers said handle and the grounding strip prevents rotational movement of, and static electrical discharges through, the fabric strip disposed around said handle.

2. The sanitary handle cover of claim 1 wherein the fabric strip further comprises a first short edge and a second short edge wherein a frilled edge is disposed on each of said first and second short edges.

3. The sanitary handle cover of claim 2 wherein the fabric strip may be reversibly attached around said handle, whereby the surface disposed contacting the handle in question is alternately positional outfacing from the handle.

4. The sanitary handle cover of claim 3 wherein the fastening means comprises a hook and loop fastener disposed on opposing surfaces of each of the first flap and the second flap.

5. The sanitary handle cover of claim 3 wherein the fastening means comprises a row of snaps disposed on opposing surfaces of each of the first flap and the second flap whereby the first flap is releasably attachable to the second flap.

6. The sanitary handle cover of claim 4 wherein the fabric strip is polymeric or vinyl.

7. The sanitary handle cover of claim 5 wherein the fabric strip is polymeric or vinyl.

8. A sanitary handle cover comprising:

a fabric strip having a first long edge, a second long edge, a first short edge, and a second short edge;

a first flap disposed along the first long edge;

a second flap disposed along the second long edge;

a grounding strip disposed within the interior of the fabric strip;

a hook and loop fastener disposed on opposing surfaces of each of the first flap and the second flap whereby the first and second flaps are releasably attachable; and a frilled edge disposed on each of the first short edge and the second short edge;

wherein the fabric strip is releasably attachable around a handle disposed on a kitchen appliance whereby the fabric strip covers said handle and the grounding strip resists rotational movement of the fabric strip around said handle and prevents the discharge of static electricity through the device.

9. The sanitary handle cover of claim 7 wherein the fabric strip may be reversibly attached around said handle, whereby the surface disposed contacting the handle in question is turned outfacing from the handle.

10. The sanitary handle cover of claim 9 wherein the fabric strip is polymeric or vinyl.

11. A sanitary handle cover comprising:

a fabric strip having a first long edge, a second long edge, a first short edge, and a second short edge;

a first flap disposed along the first long edge;

a second flap disposed along the second long edge;

a grounding strip disposed within the interior of the fabric strip;

a row of snaps disposed on opposing surfaces of each of the first flap and the second flap whereby the first and second flaps are releasably attachable; and a frilled edge disposed on each of the first short edge and the second short edge;

wherein the fabric strip is releasably attachable around a handle disposed on a kitchen appliance whereby the fabric strip covers said handle and the grounding strip resists rotational movement of the fabric strip around said handle and prevents the discharge of static electricity through the device.

12. The sanitary handle cover of claim 11 wherein the fabric strip may be reversibly attached around said handle, whereby the surface disposed contacting the handle in question is turned outfacing from the handle.

13. The sanitary handle cover of claim 12 wherein the fabric strip is polymeric or vinyl.

* * * * *